US010336586B2

(12) United States Patent
Liukko-Sipi

(10) Patent No.: US 10,336,586 B2
(45) Date of Patent: Jul. 2, 2019

(54) APPARATUS, METHODS, COMPUTER PROGRAM, AND COLLECTION FOR GENERATING IMAGE DATA OF LOAD STACK

(71) Applicant: KONECRANES GLOBAL CORPORATION, Hyvinkää (FI)

(72) Inventor: Lauri Liukko-Sipi, Espoo (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 15/540,099

(22) PCT Filed: Dec. 22, 2015

(86) PCT No.: PCT/FI2015/050933
§ 371 (c)(1),
(2) Date: Jun. 27, 2017

(87) PCT Pub. No.: WO2016/107979
PCT Pub. Date: Jul. 7, 2016

(65) Prior Publication Data

US 2017/0355574 A1 Dec. 14, 2017

(30) Foreign Application Priority Data

Dec. 31, 2014 (FI) ..... 20146173

(51) Int. Cl.
*B66C 13/16* (2006.01)
*B66C 13/46* (2006.01)
*B66C 19/00* (2006.01)

(52) U.S. Cl.
CPC ..... *B66C 13/46* (2013.01); *B66C 13/16* (2013.01); *B66C 19/007* (2013.01)

(58) Field of Classification Search
CPC ..... B66C 13/46
USPC ..... 382/100
See application file for complete search history.

(56) References Cited

U.S. PATENT DOCUMENTS 6,081,292 A 6/2000 Lanigan, Jr. et al.
6,256,553 B1 7/2001 Erikkilä
2002/0024598 A1 2/2002 Kunimitsu et al.
2002/0191813 A1* 12/2002 Uchida ..... B66C 13/085 382/100

(Continued)

FOREIGN PATENT DOCUMENTS

GB 2 425 520 A 11/2006
JP 2005289591 * 3/2004 ..... B66C 13/22

(Continued)

OTHER PUBLICATIONS

Finnish Search Report, issued in Priority Application No. 20146173, dated Aug. 26, 2015.

(Continued)

*Primary Examiner* — Justin P. Misleh
(74) *Attorney, Agent, or Firm* — Birch, Stewart, Kolasch & Birch, LLP

(57) ABSTRACT

Image data is generated from a load stack in the operating area of a load handling apparatus. The image data includes a sight apparatus having several lines that are set in relation to each other such that the lines correspond to at least two sides of the lowest load in the load stack and at least two sides of a load set on top of the lowest load in the load stack.

13 Claims, 1 Drawing Sheet

(56) References Cited

U.S. PATENT DOCUMENTS

| | | | | |
|---|---|---|---|---|
| 2010/0110185 | A1* | 5/2010 | Tafazoli Bilandi | H04N 7/183 348/143 |
| 2013/0013144 | A1* | 1/2013 | Tanizumi | B66C 23/905 701/34.4 |
| 2013/0103271 | A1* | 4/2013 | Best | G06F 19/00 701/50 |
| 2016/0119589 | A1* | 4/2016 | Tanizumi | B66C 13/46 348/144 |

FOREIGN PATENT DOCUMENTS

| | | | |
|---|---|---|---|
| JP | 2005-289591 | A | 10/2005 |
| WO | WO 2014/053703 | A1 | 4/2014 |

OTHER PUBLICATIONS

International Preliminary Report on Patentability, issued in PCT/FI2015/050933, dated Apr. 18, 2017.

International Search Report, issued in PCT/FI2015/050933, dated Apr. 7, 2016.

Ng et al., "An assessment of various two-dimensional display designs for a camera-based remote freight handling system", Proc. APCHI/ASEAN Ergonomics 2000, pp. 68-74.

Written Opinion of the International Searching Authority, issued in PCT/FI2015/050933, dated Apr. 7, 2016.

Yoon et al., "Real-time container position estimation method using stereo vision for container auto-landing system", Int. Conf. on Control, Automation and Systems, Oct. 27-30, 2010, Kintex, Gyeonggi-do, Korea, pp. 872-876.

* cited by examiner

APPARATUS, METHODS, COMPUTER PROGRAM, AND COLLECTION FOR GENERATING IMAGE DATA OF LOAD STACK

BACKGROUND OF THE INVENTION

The invention relates to load handling with a load handling apparatus.

Handling a load with a gantry crane requires that the hoist trolley be precisely positioned above the load. Cameras are typically used in the positioning. Positioning is especially demanding when using long containers, in which case the positioning may need to be repeated several times and even in a situation where a container grapple has been lowered close to the container for picking it up.

BRIEF DESCRIPTION OF THE INVENTION

An aspect of the invention relates to the subject matter of the independent claims. Some embodiments are disclosed in the dependent claims.

Some embodiments make it possible to direct the load handling apparatus to the load to be handled so that the rate and precision of the load handling can be improved.

BRIEF DESCRIPTION OF THE FIGURES

The invention will now be described in more detail in connection with preferred embodiments and with reference to the accompanying drawings, in which.

DETAILED DESCRIPTION OF THE INVENTION

Figure 1:
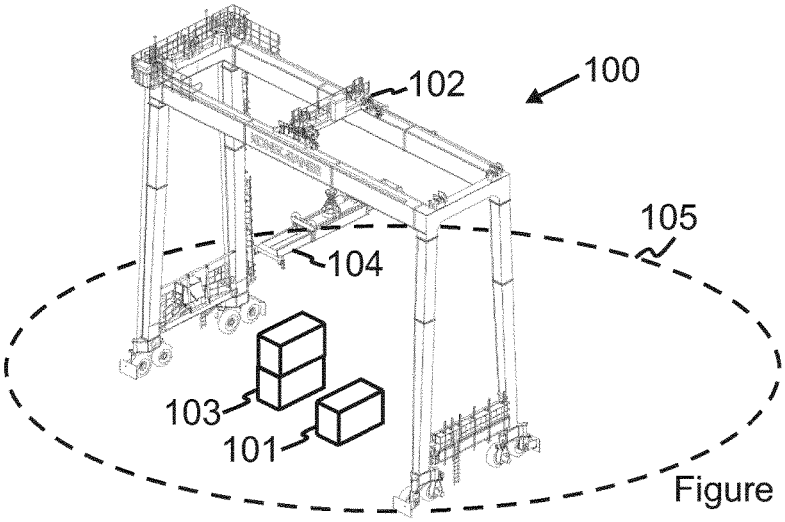
FIG. 1 shows a load handling apparatus according to an embodiment.

FIG. 1 shows a load handling apparatus 100 according to an embodiment. The load handling apparatus has an operating area 105, within which it handles a load 101 or loads 103. The loads may be stacked on top of each other to form load stacks 103. Examples of loads include containers and tanks. The containers may be standard-sized sea containers that are handled in ports. Containers are boxlike transport units having standard dimensions, either 20, 40 or 45 feet in length. A container is about 2.5 meters in width, and the most typical container heights are about 2.6 meters and 2.9 meters. A load handling apparatus can grab a load with gripping means 104, such as a hook, lines, magnet, ropes and/or container grapple, and move the load within its operating area. The gripping means can grab the load for the purpose of handling it. Handling a load may consist of stacking, grabbing and/or transporting loads. Loads may be handled on a suitable platform, such as on the ground, on top of a vehicle or on top of another load.

The operating area of a load handling apparatus may comprise an area, such as port area, where the load handling apparatus may move the load from one place to another by grabbing the load and moving in the area. The operating area may also be an area, where the load handling apparatus moves the load without moving itself. The operating area of a load handling apparatus may also be a combination of the above areas.

Examples of load handling apparatuses include a crane, such as gantry crane, bridge crane, rubber-tired gantry crane (RTG), rail-mounted gantry crane (RMG), and straddle carrier.

Figure 2A:
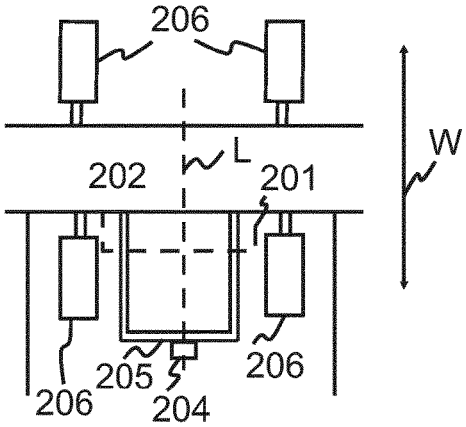
FIGS. 2*a* and 2*b* show a camera mounted on the load handling apparatus according to an embodiment.
Figure 2B:
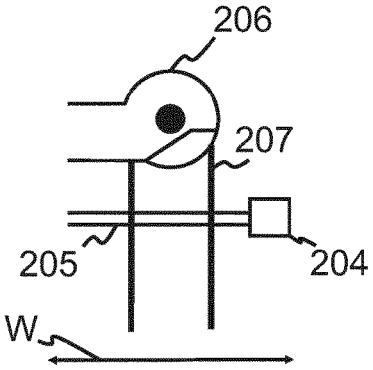

In an embodiment, the load handling apparatus 100 comprises an apparatus 102 movable horizontally above the load and having a substantially vertically movable element between the load and horizontally movable apparatus for positioning on top of the load. This type of load handling apparatus may be a bridge crane or gantry crane, in which the horizontally movable apparatus is a hoist trolley that is movable on a bridge connecting the vertical supports of the crane. The hoist trolley has a hoisting mechanism, to which gripping means are coupled to move as the element positioned vertically on top of the load. The gripping means may be any one of those described above. The hoist trolley may be at a height, such as 23 m, that permits the handling of load stacks below the load handling apparatus. FIGS. 2*a* and 2*b* show a camera 204 mounted on a load handling apparatus according to an embodiment. In FIG. 2*a*, the load handling apparatus is shown from the top and in FIG. 2*b* from the side. The load handling apparatus may be a load handling apparatus described in connection with FIG. 1. The load handling apparatus may comprise an apparatus, such as a hoist trolley, which is movable horizontally 'W' above the load or load stack 201 and on which a camera is mounted to shoot the load stack and/or load handling area from the top. The load handling apparatus comprises a hoisting mechanism 206, to which gripping means 207 are coupled to connect the load handling apparatus to the load. The camera is mounted to be preferably vertically above the load and horizontally on the hoisting line of the load. This way, the side of the load stack can be seen in the camera view. Preferably, the camera produces image data that comprises the side of the load stack along the entire height of the load stack.

The gripping means may be ropes that are coiled and uncoiled by motor. Each rope can be guided to the desired hoisting line by guide wheels, for example.

In an embodiment, the camera 204 is mounted on a centre line 'L' of a horizontally 'W' movable apparatus and directed toward a load. This way, the load or load stack to be handled by the load handling apparatus settles in the middle of the camera view, when the load handling apparatus is above the load or load stack on the hoisting line thereof.

The hoisting line of the load or load stack may be defined as the direction of the gripping means 207 connecting the load handling apparatus to the load between the hoisting apparatus and load. The hoisting line extends between the load handling apparatus and load in the vertical direction, for instance. There may be several hoisting lines, in which case the position of the load to be handled is centred on all hoisting lines. This way, the distance of the load to each of the gripping means is nearly the same. The load handling apparatus may, thus, move the load on the hoisting line at least in the vertical direction. On the hoisting line, the load may move upward from the ground to a desired height and/or downward from the hanging height to the ground, for instance. Instead of the ground, the load may also be set on other suitable platforms. Examples of other platforms include vehicles and other loads.

The camera 204 may be fastened to the horizontally movable apparatus, such as hoist trolley, of the load handling apparatus by a support structure 205 that extends horizontally 'W' to the side from the frame 202 of the horizontally movable apparatus. Preferably, the support structure extends horizontally 'W' to the side beyond the load hoisting line. This way the camera view of a downward-directed camera may show the side of the load stack, whereby the camera may form image data that contains the objects that reside from the centre line of the horizontally movable apparatus toward the load stack, on the hoisting line of the edge of the load stack closest to the camera. The objects in the image data may comprise the gripping means of the load handling apparatus, a load stack and/or at least part of the operating area of the load handling apparatus.

Figure 3:
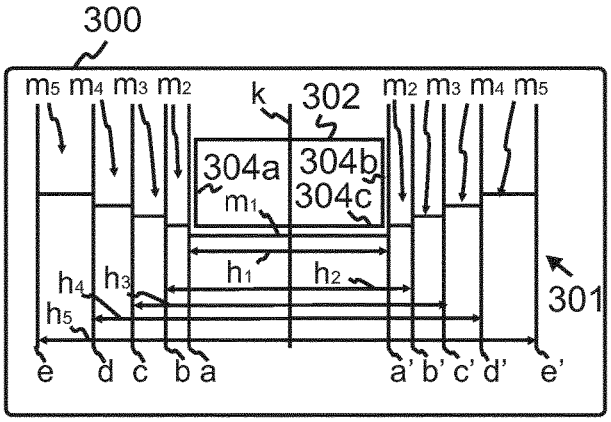
FIG. 3 shows a sight apparatus according to an embodiment.

FIG. 3 shows a sight apparatus 301 according to an embodiment. The sight apparatus is shown as part of image data 300 that contains a view from the load handling area of the load handling apparatus. The view may contain the gripping means, load stack and/or at least part of the operating area of the load handling apparatus. In the load handling area, there is a load 302 that, for the sake of clarity, is shown slightly apart from the lines of the sight apparatus. The load handling apparatus can be controlled to make the lines of the sight apparatus and the sides of the load coincide, in which case the load can be handled. The load handling apparatus may be any of those described above having gripping means for handling the load. The image data may be generated by optical means, such as an optical surface or a camera, that may receive visible light and modify, such as refract, diffuse, screen, visible light.

The optical means may be mounted on the load handling apparatus in the manner shown in FIGS. 2*a* and 2*b*, in which case the optical means have a view, from which image data can be generated.

The sight apparatus has a pattern comprising several lines {a, a'; b, b'; c, c'; d, d'; e, e'}, {$m_1$, $m_2$, $m_3$, $m_4$ and $m_5$} that are positioned in relation to each other in such a manner that the lines correspond to at least two sides of the lowest load 302 in the load stack and at least two sides of the load set on top of the lowest load 302 in the load stack. This way, the sight apparatus has at least two lines for each load. The pattern of the sight apparatus may also have more than two lines. The sides 304*a*, 304*b*, 304*c* of the load corresponding to the lines may be opposite sides 304*a*, 304*b* or adjacent sides. The lines corresponding to the loads of the different layers in the load stack can be set in relation to each other according to the perspective of the load. The lines corresponding to different layers in the load stack can be set on a desired side of the load or on both sides of the load. In an example, the lines corresponding to the sides of the load may correspond to the right side 304*b* of the load and the side 304*c* adjacent to the right side. In an example, the lines corresponding to the sides of the load may correspond to the left side 304*a* of the load and the side 304*c* adjacent to the left side. The lines may be set on different layers either left- or right-handedly as described above.

In an embodiment, the sight apparatus has a pattern that comprises side-by-side line pairs {a, a'; b, b'; c, c'; d, d'; e, e'}. There are one, two or more line pairs. The lines of the first line pair {a, a'} are set at a distance $h_1$ from each other that corresponds to the distance of the opposite sides 304*a*, 304*b* of the load from each other for the lowest load 302 of the load stack, and the lines {b, b'; c, c'; d, d'; e, e'} of at least one other line pair are set at a distance from each other that corresponds to the distance $h_2$, $h_3$, $h_4$, $h_5$ of the opposite sides of the load from each other for a load set on the lowest load in the load stack. This way, each height of the load stack has its own line pair and the load handling apparatus can be controlled to be on top of the load stacks of different heights with the sight apparatus. In the image data, the distance of the lines from each other may be in the range of a few tens of millimeters. The opposite sides of the load may be the ends of the load that are shorter than the side 304*c* connecting the ends.

In an embodiment, the pattern of the sight apparatus 301 further comprises a centre line 'k', in relation to which the other lines of the sight apparatus are symmetrical. This way, the sight pattern can be made symmetrical, whereby the controlling of the load handling apparatus with the sight apparatus becomes easier.

In FIG. 3, height $h_2$ corresponds to the distance between the opposite sides of the load set on top of the lowest load, i.e. the load of the second layer. In FIG. 3, height $h_3$ corresponds to the distance between the opposite sides of the load set on top of the second lowest load, i.e. the load of the third layer. In FIG. 3, height $h_4$ corresponds to the distance between the opposite sides of the load set on top of the third lowest load, i.e. the load of the fourth layer. In FIG. 3, height $h_5$ corresponds to the distance between the opposite sides of the load set on top of the fourth lowest load, i.e. the load of the fifth layer. The number of loads stacked on top of each other may also be higher than five. On the other hand, the number of loads stacked on top of each other is at least two. The number of line pairs corresponds to the height of the stack.

In an embodiment, the sight apparatus 301 comprises lines {$m_1$, $m_2$, $m_3$, $m_4$, $m_5$} connecting the line pairs {a, a'; b, b'; c, c'; d, d'; e, e'} and each line corresponds to the side 304*c* connecting the opposite sides 304*a*, 304*b* of the load. The opposite sides may be the ends of the load and shorter than the side connecting the ends. The first line pair {a, a'} is connected by line $m_1$. The line $m_1$ connecting the first line pair corresponds to the side of the lowest load in the load stack in such a manner that the line $m_1$ connecting the line pair is preferably parallel to the side connecting the opposite sides of the load, when the lines a and a' are parallel to the opposite sides of the load. Each line of the line pair corresponding to the opposite sides of the load on the next layer of the load stack is connected by a line {$m_2$, $m_3$, $m_4$ and $m_5$} to the line of the line pair on the higher layer that corresponds to the same load side of the opposite load sides. This way, the sight apparatus has, for each load stack layer, a line {$m_1$, $m_2$, $m_3$, $m_4$ and $m_5$} with which the load handling apparatus can be controlled in relation to the side 304*c* connecting the opposite sides of the load.

In an embodiment, the lines and/or line pairs {a, a'; b, b'; c, c'; d, d'; e, e'} may be outlines according to the perspective of the load. The load may be a container, such as a sea container, in which the lines of a line pair and the connecting lines {$m_1$, $m_2$, $m_3$, $m_4$ and $m_5$} can be perpendicular to each other according to the rectangular shape of the containers.

The pattern of the sight apparatus, for example the distance between the lines or line pair lines and the location of the lines connecting the line pairs, can be determined on the basis of the height of the camera. The height of the camera determines the perspective, from which the load is examined. The height of the load as seen from the camera location depends on the position of the load in the load stack. The height of the lowest load in the load stack is, as a distance between the lines of the line pair, shorter than the height of the load stacked on top of the lowest load. The distance between the lines of the line pair for a load underneath another load in the load stack is, thus, shorter than the distance between the lines of the line pair on the upper load. The locations of the lines connecting the line pairs are elevated in relation to the line connecting the first line pair.

The sight apparatus 301 can be part of image data 300 as shown in with FIG. 3. The image data may be image data on an apparatus, such as an optical surface or storage medium. The sight apparatus can be engraved or painted on the optical surface, in which case light passing through the optical surface forms the sight apparatus on a screen, for instance. An optical surface can be installed in front of the camera shutter, in which case the sight apparatus is formed in the image data generated by the camera. The optical surface can also be installed on a display surface, in which case a sight apparatus can be made visible on the displayed data. The optical surface may be a surface translucent to visible light and made of glass or plastic, for instance. The optical surface may be sheet-like and arranged to be equal in size to the display surface or fitting in a camera shutter. The sight apparatus may also be stored on a storage medium in digital format. A sight apparatus in digital format may be suitable for presentation as an image on a display. The digital format may be a file, such as an image file, readable by a processor or computer. Suitable image file formats comprise bitmap files and vector graphic files, such as BMP (Microsoft Windows/OS/2 bitmap, Apparatus-Independent Bitmap), JPEG (Joint Photographic Experts Group) and SVG (Scalable Vector Graphics) file formats.

The optical surface may be installed on a load handling apparatus in a corresponding manner as described in connection with FIGS. 2*a* and 2*b* on a camera or in front of a camera directed to a load handling area. This way, the optical surface can produce image data with a sight apparatus so that the location of the load handling apparatus can be detected in relation to the load stack through the sight apparatus.

Figure 4:
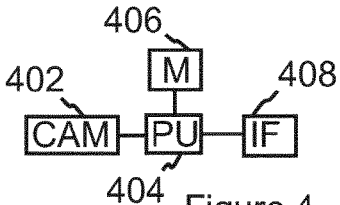
FIG. 4 shows an apparatus according to an embodiment.

FIG. 4 shows an apparatus according to an embodiment. The apparatus comprises a camera (CAM) 402 for generating image data from the load handling area of a load handling apparatus, a processor (PU) 404, a memory (M) 406 and a user interface unit (IF) 408 that are coupled to each other in such a manner that image data can be transmitted from the camera to the user interface unit under the control of the processor. It should be noted that the image data can be fed from the camera to the user interface unit under the control of the processor directly or through the processor and/or memory space. The units in FIG. 4 may be electrically connected by electric conductors or over an electric bus, for instance. The electric connection or bus may be implemented by a Profibus field bus, Ethernet connection and/or computer bus. The memory may store program code, such as computer program code executable in the processor, whereby the sight apparatus according to the embodiment can be displayed in the user interface.

The user interface unit may comprise a display, such as a liquid crystal display (LCD). The display can be used for displaying information, for instance the sight apparatus, to the user. The display may be a touch screen, in which case instructions may be received from the user through the screen. The display can be implemented by a tablet computer, for instance, in which case the connection for transmitting data and/or image data can be implemented over a wireless data communications connection, such as a wireless local area network (WLAN) connection based on the IEEE 802.11 standard, or a Bluetooth connection.

The sight apparatus can be displayed on the screen as image data, an example of which is shown in connection with FIG. 3. The image data may be a video or a still image, preferably a video, in which case in the image data displayed in the user interface, the position of the sight apparatus in relation to the load can be monitored continuously so that the load handling apparatus can be directed toward the load on the basis of the sight apparatus.

The processor and memory may form a processing unit in a data processing apparatus that may be a computer or a PLC (Programmable Logic Controller) that is used in hoisting apparatuses. For instance, the apparatus of FIG. 4 may be one of the above-mentioned load handling apparatuses, to which a camera or optical surface is installed according to the examples of FIGS. 2*a* and 2*b*.

Figure 5:
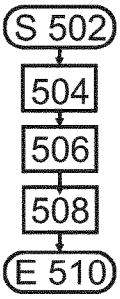
FIG. 5 shows a method according to an embodiment.

With reference to FIG. 5, an example is presented of a method according to an embodiment. A camera is installed in a load handling apparatus and is in operation 502. The method may be executed, when load is handled with the load handling apparatus, such as the one described in FIG. 1. The camera produces image data from the load handling area. The image data may comprise objects such as the gripping means, load and/or load stacks. FIGS. 2*a* and 2*b* show an example of how the camera is installed in the load handling apparatus. Image data is received 504 from the camera and a sight apparatus can be added 506 to it under the control of the processor. The sight apparatus may be stored in the memory, from which it can be fetched for processing the image data. After this, the image data can be displayed 508 on the screen for the user by feeding the image data to the screen. The user may be the operator of the load handling apparatus. Image data is displayed 510 to the user during the handling of the load and the image data may be updated so that the user can see the changes between the sight apparatus and other objects of the image data and control the load handling apparatus accordingly. The sight apparatus in the image data makes it possible to improve the precision of load handling.

In an embodiment, the pattern of the sight apparatus is altered. The pattern of the sight apparatus may comprise sight pattern data that defines the sight pattern shown in connection with FIG. 3, for example. The sight pattern data may comprise geographical information on lines or line pairs, geographical, length and/or number information on lines between line pairs. In an example, the sight pattern is altered to correspond to a change in the installation height of a camera or optical surface. The changes may be made automatically or by receiving, from the user, sight pattern information, such as an entirely new pattern or changes to the present pattern. On the basis of the sight pattern information received from the user, a new pattern can be formed for the sight apparatus for use in directing the load handling apparatus. Preferably, the new sight pattern is stored in the memory, from which it can be added to the image data received from the camera for display in the user interface unit. This way, the sight apparatus can be changed without changes to the physical structures of the camera, and the sight apparatus can be updated to correspond to the changes, such as changes in the installation site or the size of the containers to be handled. Several different sight patterns can be stored in a menu that is displayed in the user interface so that the user may select from the menu the sight apparatus to be used in load handling. This way, the user may select via the user interface a pattern that corresponds to the dimensions of the load to be handled and/or the installation height of the camera or optical surface. Different sight patterns may, thus, correspond to loads of different sizes, which may be standardized in size.

An embodiment comprises a selection of optical surfaces or sight patterns, each having a sight apparatus according to an embodiment. Each optical surface or sight pattern comprises a sight apparatus, the pattern of which is adapted to correspond to a specific size of a load to be handled. The optical surfaces can be set in the user interface unit, for instance on top of the screen. When handling a load of a specific size, the optical surface corresponding to the size of the load is set on top of the screen, so the camera image of the load handling area of the load handling apparatus shown on the screen contains a sight apparatus, whereby the precision of the load handling can be improved. The sight pattern of the optical surface can be adapted to correspond to a specific size of a container to be handled by dimensioning the pattern on the basis of the camera height and for a specific load size. It is easy to make optical surfaces for every different standardized container size, especially for loads, such as containers, with sizes that vary within the limits of different standardized sizes. The sight patterns may be displayed in a menu on the screen. The user may select with the user interface unit from the menu the sight pattern to be used in load handling, in which case the sight apparatus can be added to the image data received from the camera, as described above. The menu and user selections can be implemented with the user interface unit, for instance with a touch screen.

In an embodiment, the load handling apparatus is upgraded with an apparatus having a sight apparatus. The load handling apparatus can be updated by installing a camera, an optical surface having a sight apparatus according to the embodiment described above into the load handling apparatus as shown in FIGS. 2*a* and 2*b*. On the other hand, the storage medium of the load handling apparatus can be updated by storing on the storage medium a sight apparatus according to the embodiment described above or by replacing the sight apparatus stored in the storage medium by a new sight apparatus that may have a different pattern than that stored in the storage medium.

In an embodiment, the load handling apparatus comprises an apparatus that is movable horizontally above the load and has an element that is movable essentially vertically between the load and the horizontally movable apparatus and positionable on top of the load. The optical surface and/or camera can be installed in the load handling apparatus in such a manner that image data having a sight apparatus is produced and the produced image data is displayed to the user, such as the operator of the load handling apparatus. This way, the sight apparatus indicates the horizontal and vertical location of the load handling apparatus in relation to the load. The load handling apparatus may comprise a apparatus that is movable horizontally above the load and has an element that is movable essentially vertically between the load and the horizontally movable apparatus and positionable on top of the load, in which case the sight apparatus may indicate the horizontal and vertical location of the positionable element in relation to the load.

The techniques of the embodiments described above can be implemented using many different means in such a manner that the load handling apparatus or an apparatus implementing any one of the operations described above comprises prior-art means as well as means for generating image data of a load stack in the operating area of the load handling apparatus, in which case the image data comprises a sight apparatus having several lines that are set in relation to each other such that the lines correspond to at least two sides of the lowest load in a load stack and at least two sides of a load set on top of the lowest load in the load stack.

The functions of the apparatus according to the embodiments described above can be implemented using means corresponding to them. Each function can be implemented using its own means or several functions can be implemented using the same means. In an example, the techniques of the embodiments described above can be implemented using equipment that contains one or more apparatuses, software comprising one or more modules, firmware, or a combination of all these. The firmware or software can be implemented by modules (e.g. as procedures or functions) that implement the functions described above. Program codes can be stored on any suitable data storage means, memory unit or product readable by a processor and/or computer and executed by one or more processors and/or computers. The data storage medium may be implemented internally or externally to the processor and/or computer, in which case it may be connected communicatively to the processor and/or computer in various known ways.

In an embodiment, the load handling apparatus or a part thereof comprises processing means that are configured to execute functions described in an embodiment.

In an embodiment, at least one processor, memory, and computer program code form the processing means according to the embodiment for executing an embodiment.

An embodiment comprises a computer program included in a computer-readable storage medium, and the computer program comprises program code which, when executed on a processor or computer, produces functions according to an embodiment.

The embodiments can be implemented as a computer process that is defined by a computer program. The computer program may be in source code format, object code format or an intermediate format, and the computer program can be stored on a storage medium that may be any piece or apparatus that is capable of storing the computer program. For instance, a computer program can be stored on a computer program distribution medium that can be read by a computer or processor. The computer program distribution medium may comprise a storage medium, computer memory, read-only memory (ROM), electric carrier wave, telecommunications signal, and software distribution package, for instance.

An embodiment comprises a computer program product for a computer, the computer program product comprising program code portions for executing functions according to any of the embodiments described above.

It is apparent to a person skilled in the art that as technology advances, the basic idea of the invention may be implemented in many different ways. The invention and its embodiments are thus not restricted to the examples described above but may vary within the scope of the claims.

The invention claimed is:

1. An apparatus comprising:

a camera configured to generate image data of a load stack in an operating area of a load handling apparatus, the load stack being formed with a plurality of loads stacked together including a first load and a second load stacked on top of the first load; and a processor configured to add a sight apparatus to the image data to generate a composed image for improving precision of a load handling operation by the load handling apparatus, wherein the sight apparatus has several lines, the several lines comprising at least two parallel line pairs, the at least two parallel line pairs including a first line pair and a second line pair, lines of the first line pair corresponding to at least two opposite sides of the first load and set at a distance from each other that corresponds to a distance between the two opposite sides of the first load, and lines of the second line pair corresponding to at least two opposite sides of the second load and set at a distance from each other that corresponds to a distance between the two opposite sides of the second load, and wherein the first line pair and the second line pair represent different heights of the first load and the second load respectively.

2. The apparatus as claimed in claim 1, wherein the sight apparatus comprises a first connecting line connecting the first parallel line pair and corresponding to a line connecting the two opposite sides of the first load, and a second connecting line connecting the second parallel line pair and corresponding to a line connecting the two opposite sides of the second load.

3. The apparatus as claimed in claim 1, wherein the sight apparatus comprises a centre line, and the at least two parallel line pairs are symmetrical with respect to the centre line.

4. The apparatus as claimed in claim 1, wherein the image data comprises at least one vertical side of the load stack along an entire height of each load.

5. The apparatus as claimed in claim 1, wherein the several lines are outlines according to the perspective of the plurality of loads.

6. The apparatus as claimed in claim 1, wherein each of the first load and the second load is a container.

7. A load handling apparatus comprising:

the apparatus as claimed in claim 1 mounted on the load handling apparatus; and a horizontally movable apparatus movable horizontally above the load stack and having a substantially vertically movable element between the load stack and horizontally movable apparatus for positioning on top of the load stack, and the apparatus mounted on the load handling apparatus is mounted on the horizontally movable apparatus, wherein the substantially vertically movable element is operable to be positioned in relation to the load based on the composed image.

8. The load handling apparatus as claimed in claim 7, wherein the sight apparatus indicates a horizontal and vertical location of the substantially vertically movable element in relation to the load stack.

9. The load handling apparatus as claimed in claim 7, wherein the image data comprises objects that are located from a centre line of the horizontally movable apparatus toward the load stack, to a hoisting line on an edge of the load stack that is closest to the camera.

10. A method for upgrading a load handling apparatus, comprising the step of mounting the apparatus as claimed in claim 1 on the load handling apparatus.

11. A method comprising the steps of:

receiving image data from a camera installed on a load handling apparatus concerning a load stack in an operating area of the load handling apparatus;

adding to the image data a sight apparatus having several lines to generate a composed image with the added sight apparatus for improving precision of a load handling operation by the load handling apparatus; and displaying the image data with the added sight apparatus on a screen, wherein the several lines of the sight apparatus comprises at least two parallel line pairs, the at least two parallel line pairs including a first line pair and a second line pair, lines of the first line pair corresponding to at least two opposite sides of the first load and set at a distance from each other that corresponds to a distance between the two opposite sides of the first load, and lines of the second line pair corresponding to at least two opposite sides of the second load and set at a distance from each other that corresponds to a distance between the two opposite sides of the second load.

12. The method as claimed in claim 11, further comprising the step of displaying a menu presenting several sight patterns that correspond to loads of different sizes, wherein the sight apparatus to be used in the load handling operation is defined as a sight pattern selected from the several sight patterns by the user from the menu.

13. A non-transitory computer-readable storage medium having computer-executable program code instructions stored therein, the computer-executable program code instructions, when executed on a computer, instructing the computer to perform the method of claim 11.

* * * * *